US009952549B2

(12) United States Patent
Shimomura et al.

(10) Patent No.: US 9,952,549 B2
(45) Date of Patent: Apr. 24, 2018

(54) FIXING APPARATUS AND IMAGE FORMING APPARATUS

(71) Applicant: KONICA MINOLTA, INC., Chiyoda-ku, Tokyo (JP)

(72) Inventors: Midori Shimomura, Hino (JP); Dai Suwama, Hachioji (JP); Miho Yamano, Kokubunji (JP); Hiroyuki Maeda, Toyokawa (JP)

(73) Assignee: KONICA MINOLTA INC., Tokyo (JP)

( * ) Notice: Subject to any disclaimer, the term of this patent is extended or adjusted under 35 U.S.C. 154(b) by 0 days.

(21) Appl. No.: 15/391,759

(22) Filed: Dec. 27, 2016

(65) Prior Publication Data

US 2017/0199489 A1 Jul. 13, 2017

(30) Foreign Application Priority Data

Jan. 8, 2016 (JP) ..... 2016-002143

(51) Int. Cl.
*G03G 15/00* (2006.01)
*G03G 15/20* (2006.01)

(52) U.S. Cl.
CPC ..... *G03G 15/70* (2013.01); *G03G 15/2028* (2013.01); *G03G 15/2053* (2013.01); *G03G 2215/2032* (2013.01)

(58) Field of Classification Search
CPC ..... G03G 15/70
USPC ..... 399/70, 21
See application file for complete search history.

(56) References Cited

U.S. PATENT DOCUMENTS 5,713,059 A * 1/1998 Ishikawa ..... B41J 29/393 226/100
5,991,570 A * 11/1999 Haga ..... G03G 21/1633 399/113
6,754,458 B2 * 6/2004 Makihira ..... G03G 15/2003 399/122
8,412,056 B2 * 4/2013 Furuichi ..... G03G 21/16 399/110
2002/0037186 A1 * 3/2002 Tanaka ..... G03G 15/2028 399/322
2007/0014600 A1 * 1/2007 Ishii ..... G03G 15/2039 399/328

(Continued)

FOREIGN PATENT DOCUMENTS

JP 09101700 A 4/1997

*Primary Examiner* — Anthony Nguyen
(74) *Attorney, Agent, or Firm* — Holtz, Holtz & Volek PC

(57) ABSTRACT

A fixing apparatus includes: a heating member that has an outer circumferential surface to be driven in a circulative manner and heats a sheet; a heat radiation suppression member that covers a part of an outer circumferential surface of the heating member to have a predetermined gap and suppresses heat radiation, wherein the heat radiation suppression member has a movable part capable of moving to a first position and a second position more distant than the first position from a part covered by the heating member; a moving unit that moves the movable part to the first position or the second position; a jam detection unit that detects a jam of a sheet in the vicinity of the downstream side end portion of the nip part; and a control unit that controls the moving unit such that the movable part is moved from the first position to the second position.

11 Claims, 11 Drawing Sheets

(56) References Cited

U.S. PATENT DOCUMENTS

2010/0329761 A1* 12/2010 Ichiki ..... B65H 29/58
399/397

* cited by examiner

PRIOR ART

FIXING APPARATUS AND IMAGE FORMING APPARATUS

The entire disclosure of Japanese Patent Application No. 2016-002143 filed on Jan. 8, 2016 including description, claims, drawings, and abstract are incorporated herein by reference in its entirety.

BACKGROUND OF THE INVENTION

Field of the Invention

The present invention relates to a fixing apparatus and an image forming apparatus.

Description of the Related Art

Conventionally, in an electrophotographic system image forming apparatus, a fixing apparatus has been used for fixing by heating and pressurizing color material (toner) transferred onto a sheet from a photo-conductor drum or an intermediate transfer belt. In recent years, energy saving is demanded in the image forming apparatus, and, for the purpose of improving heating efficiency in the fixing apparatus, a fixing apparatus has been devised in which a heat radiation suppression member such as a reflecting member or a heat insulating member is arranged in the periphery of a heating member for suppressing heat radiation from the heating member (JP 9-101700 A).

In the fixing apparatus, there is a case in which separation failure of the sheet from the heating member occurs. Methods have been performed for this case, such as a method for separating the sheet by a separation claw mechanically, or a method for separating the sheet by blowing air between the sheet and the heating member.

However, it is difficult to avoid the separation failure completely, and in rare cases the sheet is conveyed while being in close contact with the heating member, and may cause a jam. As illustrated in FIG. 11, in a fixing apparatus 360 in which a heat radiation suppression member 370 is provided, since the heat radiation suppression member 370 is installed to cover the outer circumferential surface of a heating member 361, there has been a case in which a sheet P enters between the heating member 361 and the heat radiation suppression member 370 when the jam is caused.

In this case, there has been a possibility that damage and contamination occur in the heat radiation suppression member 370 by scraping and rubbing between the sheet P and the heat radiation suppression member 370. In particular, in the reflecting member, heat radiation suppressing effect is degraded; for example, specularity is degraded by receiving damage to the inner surface, or reflectivity is degraded by adhesion of the toner to the inner surface. In a case in which the heat radiation suppression member 370 and a part of the sheet P are in contact and fixed with each other, when the heating member 361 is damaged by scraping and rubbing between the sheet P and the heating member 361, it has been a cause of image quality degradation.

In a state in which the heating member 361 is covered by the heat radiation suppression member 370, work for removing the sheet P jammed is difficult, and workability has been poor at the time of jam processing, in comparison with a case in which there is no heat radiation suppression member 370. Since the processing is not only simply difficult to eject the sheet P jammed in a narrow space, but also deforms the sheet P during moving in the narrow space, a possibility of damaging a peripheral member when the sheet P is removed also has been high.

SUMMARY OF THE INVENTION

The present invention has been made in view of the problems in the conventional technique described above, and it is an object to reduce damage of the member in the fixing apparatus having the heat radiation suppression member, and to improve workability at the time of the jam processing.

To achieve the abovementioned object, according to an aspect, a fixing apparatus reflecting one aspect of the present invention comprises: a heating member that has an outer circumferential surface to be driven in a circulative manner and heats a sheet on which color material is transferred; a heat radiation suppression member that covers at least a part of an outer circumferential surface of the heating member to have a predetermined gap and suppresses heat radiation from the heating member, wherein the heat radiation suppression member has a movable part capable of moving to a first position in which the heat radiation from the heating member is suppressed, and a second position more distant than the first position from a part covered by the heating member in the first position, in a vicinity of a downstream side end portion in a sheet conveying direction of a nip part formed by the heating member and a facing member that faces the heating member; a moving unit that moves the movable part to the first position or the second position; a jam detection unit that detects a jam of a sheet in the vicinity of the downstream side end portion of the nip part; and a control unit that controls the moving unit such that the movable part is moved from the first position to the second position, when the jam is detected by the jam detection unit.

According to an invention of Item. 2, in the fixing apparatus of Item. 1, the second position is preferably a position which is wider than that in the first position between the movable part and the heating member in the vicinity of the downstream side end portion of the nip part.

According to an invention of Item. 3, in the fixing apparatus of Item. 2, the movable part preferably moves from the first position to the second position before a sheet of which a jam is detected by the jam detection unit reaches between the heating member and the movable part in the first position.

According to an invention of Item. 4, in the fixing apparatus of Item. 1, the second position is preferably a downstream side position from the first position in a circumferential direction of the heating member.

According to an invention of Item. 5, in the fixing apparatus of Item. 4, a moving speed along the circumferential direction of the heating member of the movable part is preferably faster than a circumferential speed of the heating member.

According to an invention of Item. 6, in the fixing apparatus of Item. 4, the moving speed along the circumferential direction of the heating member of the movable part is preferably substantially the same as the circumferential speed of the heating member.

According to an invention of Item. 7, in the fixing apparatus of any one of Items. 1 to 6, a distance from the downstream side end portion of the nip part to the jam detection unit is preferably shorter than a distance along the circumferential direction of the heating member from the downstream side end portion of the nip part to the movable part in the first position.

According to an invention of Item. 8, in the fixing apparatus of any one of Items. 1 to 7, the fixing apparatus preferably further comprises a jam resolution detection unit that detects resolution of a jam, and the control unit preferably controls the moving unit such that the movable part is moved from the second position to the first position when the resolution of the jam is detected by the jam resolution detection unit.

According to an invention of Item. 9, in the fixing apparatus of any one of Items. 1 to 8, the heat radiation suppression member preferably has at least one of a reflecting function that reflects heat radiated from the heating member, or a heat insulating function that blocks heat conduction between a side of the heating member and its opposite side sandwiching the heat radiation suppression member.

According to an invention of Item. 10, in the fixing apparatus of any one of Items. 4 to 6, the heat radiation suppression member is preferably a reflecting member that reflects heat radiated from the heating member, and includes a cleaning member that cleans a surface facing the heating member of the movable part in accordance with movement between the first position and the second position of the movable part.

To achieve the abovementioned object, according to an aspect, an image forming apparatus reflecting one aspect of the present invention comprises the fixing apparatus of any one of Items. 1 to 10.

BRIEF DESCRIPTION OF THE DRAWINGS

The above and other objects, advantages and features of the present invention will become more fully understood from the detailed description given hereinbelow and the appended drawings which are given by way of illustration only, and thus are not intended as a definition of the limits of the present invention, and wherein.

DESCRIPTION OF THE PREFERRED EMBODIMENTS

Hereinafter, embodiments of an image forming apparatus according to the present invention will be described with reference to the drawings. However, the scope of the invention is not limited to the illustrated examples.

First Embodiment

Figure 1:
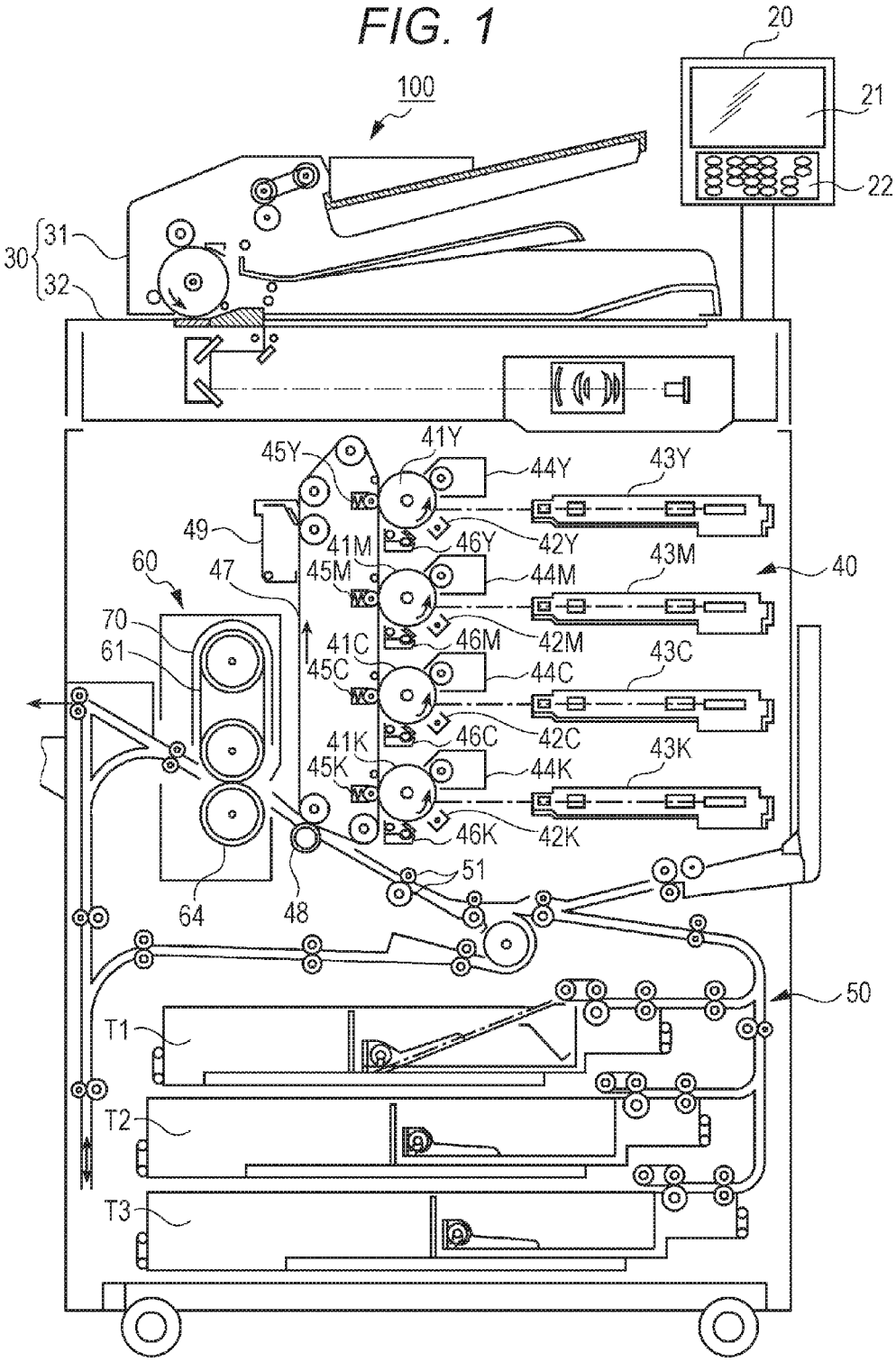
FIG. 1 is a schematic cross-sectional view illustrating an entire configuration of an image forming apparatus in a first embodiment of the present invention.
Figure 2:
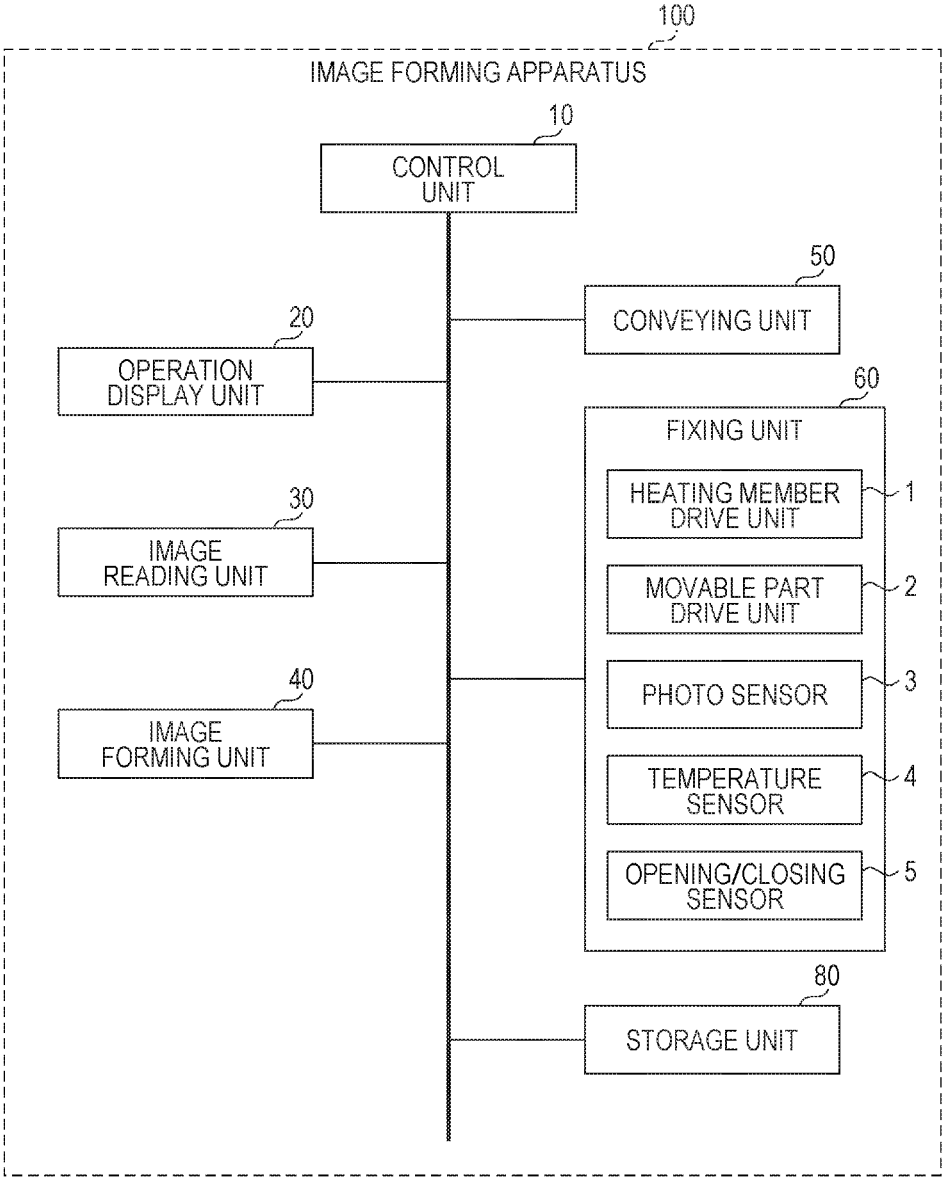
FIG. 2 is a block diagram illustrating a functional configuration of the image forming apparatus.

First, an apparatus configuration of an image forming apparatus 100 in a first embodiment of the present invention is described with reference to FIG. 1 and FIG. 2. FIG. 1 is a schematic cross-sectional view illustrating an entire configuration of the image forming apparatus 100. FIG. 2 is a block diagram illustrating a functional configuration of the image forming apparatus 100.

The image forming apparatus 100 is a tandem type image forming apparatus that forms a color image by an electrophotographic system, on the basis of image data obtained by reading an image from a document, or image data received from an external device.

The image forming apparatus 100 is configured to include a control unit 10, an operation display unit 20, an image reading unit 30, an image forming unit 40, a conveying unit 50, a fixing unit 60, and a storage unit 80.

The control unit 10 is configured by a central processing unit (CPU), read only memory (ROM), random access memory (RAM), and the like. The CPU reads various processing programs stored in the ROM and deploys the programs on the RAM, and centrally controls operation of each unit of the image forming apparatus 100 according to the programs deployed.

The operation display unit 20 includes a display unit 21, and an operation unit 22.

The display unit 21 is configured by a liquid crystal display (LCD) and the like, and displays various screens according to instructions of display signals input from the control unit 10.

The operation unit 22 includes a touch panel formed to cover a display screen of the display unit 21, and various operation buttons such as a numeric button, and a start button, and outputs an operation signal based on user operation to the control unit 10. The operation unit 22 accepts an operation instruction from the user.

The image reading unit 30 includes an auto document feeder (ADF) 31, and a scanner 32.

The ADF 31 automatically feeds the document placed on a document tray.

The scanner 32 optically scans the document conveyed onto a contact glass from the ADF 31 or the document placed on the contact glass, focuses reflected light of light for lighting and scanning from a light source to the document on a light-receiving surface of a charge coupled device (CCD) sensor, reads a document image, performs A/D conversion of the image read, and outputs the image data obtained to the control unit 10.

The image forming unit 40 includes photo-conductor drums 41Y, 41M, 41C, 41K, charging units 42Y, 42M, 42C, 42K, exposure units 43Y, 43M, 43C, 43K, developing units 44Y, 44M, 44C, 44K, primary transfer rollers 45Y, 45M, 45C, 45K, photo-conductor cleaning units 46Y, 46M, 46C, 46K respectively corresponding to colors of yellow (Y), magenta (M), cyan (C), black (K), an intermediate transfer belt 47, a secondary transfer roller 48, and a belt cleaning unit 49.

The charging units 42Y, 42M, 42C, 42K uniformly charge the photo-conductor drums 41Y, 41M, 41C, 41K, respectively.

The exposure units 43Y, 43M, 43C, 43K are each configured from a laser light source, a polygon mirror, a lens, and the like, and scan and expose surfaces of the photo-conductor drums 41Y, 41M, 41C, 41K by the lasers respectively, on the basis of image data of respective colors, and form electrostatic latent images.

The developing units 44Y, 44M, 44C, 44K cause respective color toners to adhere to the electrostatic latent images on the photo-conductor drums 41Y, 41M, 41C, 41K, and perform developing.

The primary transfer rollers 45Y, 45M, 45C, 45K sequentially transfer respective color toner images formed on the photo-conductor drums 41Y, 41M, 41C, 41K onto the intermediate transfer belt 47 (primary transfer). That is, a color toner image on which toner images of four colors are superimposed is formed on the intermediate transfer belt 47.

The secondary transfer roller 48 collectively transfers the color toner image on the intermediate transfer belt 47 onto one surface of the sheet supplied from sheet feeding trays T1, T2, T3 (secondary transfer).

The photo-conductor cleaning units 46Y, 46M, 46C, 46K remove the toners remaining on circumferential surfaces of the photo-conductor drums 41Y, 41M, 41C, 41K after the transfer, respectively.

The belt cleaning unit 49 removes residual toner from the intermediate transfer belt 47 after the color toner image is transferred to the sheet by the secondary transfer roller 48.

The conveying unit 50 includes a resist roller 51, a conveying roller for conveying the sheet, and conveys the sheet inside the image forming apparatus 100 from when supplying the sheet accommodated in the sheet feeding trays T1, T2, T3 to the image forming unit 40 until when discharging the sheet after fixing to the outside of the apparatus. In the sheet feeding trays T1, T2, T3, the sheets are accommodated of a predetermined sheet type and size for each of the sheet feeding trays.

The fixing unit 60 fixes the toner as color material transferred onto the sheet onto the sheet by heating and pressurizing.

The fixing unit 60 includes a heating member drive unit 1, a movable part drive unit 2, a photo sensor 3, a temperature sensor 4, and an opening/closing sensor 5.

The storage unit 80 is configured by a nonvolatile storage device such as a hard disk, or a flash memory, and stores various data. For example, in the storage unit 80, fixing temperatures are stored corresponding to sheet types (thick sheet, normal sheet, thin sheet, and the like). The fixing temperature is a temperature required for melting the toner when the sheet passes through a nip part in the fixing unit 60, and varies depending on the types of the sheet on which image formation is performed, and the like.

Figure 3B:
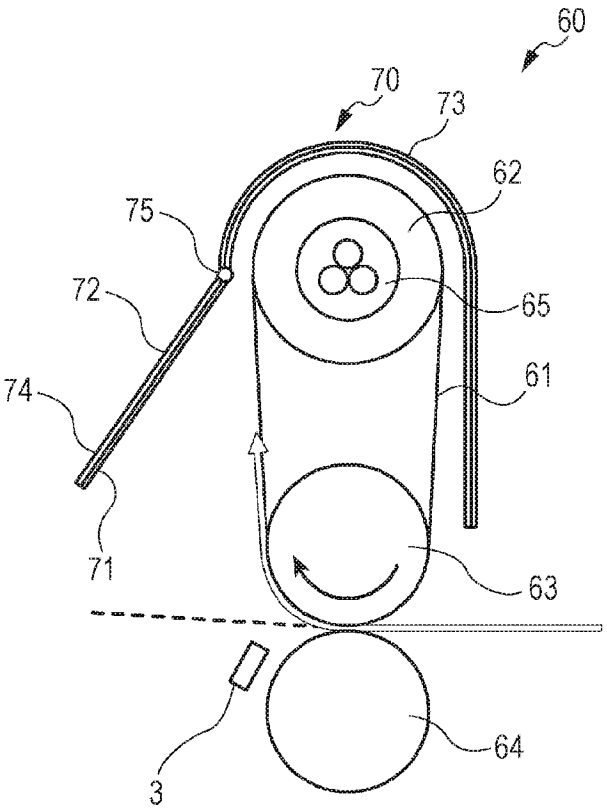
FIG. 3B is a schematic diagram illustrating a cross-sectional configuration of the fixing unit when the movable part is in a second position.
Figure 3A:
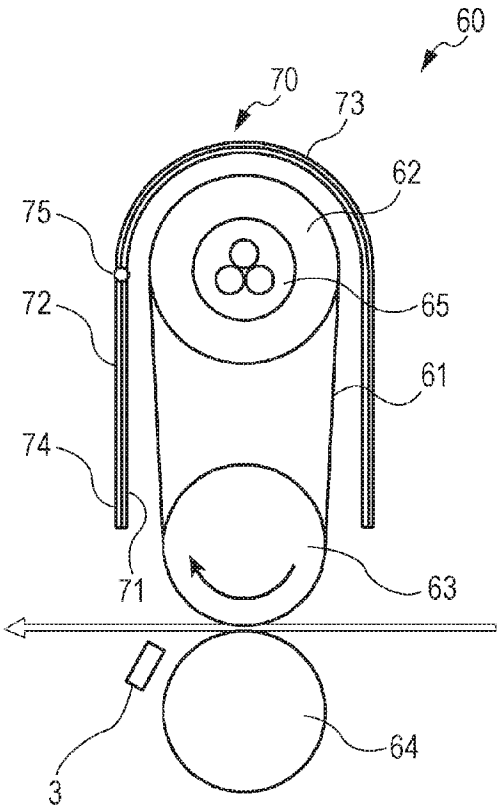
FIG. 3A is a schematic diagram illustrating a cross-sectional configuration of a fixing unit when a movable part is in a first position.

Each of FIGS. 3A and 3B schematically illustrates a cross-sectional configuration of the fixing unit 60.

The fixing unit 60 includes a fixing belt 61 as a heating member, a heating roller 62, an upper pressing roller 63, a lower pressing roller 64, and a heat radiation suppression member 70.

The fixing belt 61 is an endless belt stretched across the heating roller 62 and the upper pressing roller 63, and has an outer circumferential surface to be driven in a circulative manner. The fixing belt 61 comes in contact with the sheet to which the toner is transferred, and heats the sheet at the fixing temperature.

The heating roller 62 heats the fixing belt 61 so that the sheet is heated at a predetermined temperature by the fixing belt 61, that is, the temperature of the fixing belt 61 is the fixing temperature. In the heating roller 62, heaters 65 such as halogen heaters are respectively incorporated at a plurality of positions in an axial direction of the heating roller 62. The heaters 65 respectively heat corresponding positions in the axial direction of the heating roller 62. As a result, the corresponding positions are heated in a width direction of the fixing belt 61.

The temperature sensor 4 for measuring a temperature of the fixing belt 61 is arranged in the vicinity of the fixing belt 61. A plurality of the temperature sensors 4, each of which is configured by a thermocouple or the like, is arranged in a width direction of the sheet. The control unit 10 controls outputs of the heaters 65 at the positions respectively corresponding to the temperature sensors 4 so that the temperature measured by each of the temperature sensors 4 coincides with a predetermined temperature required for fixing. The temperature of the fixing belt 61 is controlled in a range of, for example, 160 to 200° C.

The upper pressing roller 63 is arranged to face the lower pressing roller 64 in order to form the nip part between the fixing belt 61 and the lower pressing roller 64.

The heating member drive unit 1 drives the fixing belt 61 in a circulative manner by rotating the heating roller 62 or the upper pressing roller 63. Drive control of the heating member drive unit 1 is performed by the control unit 10.

The lower pressing roller 64 is pressed by the upper pressing roller 63 via the fixing belt 61. The lower pressing roller 64 is pressed against the fixing belt 61 by an urging device for urging the lower pressing roller 64 to the upper pressing roller 63 at the time of fixing, and is released from being pressed against the fixing belt 61 at the time of non-use. The sheet passes through the nip part formed by pressing the fixing belt 61 and the lower pressing roller 64 to each other, whereby the image on the sheet is fixed.

The heat radiation suppression member 70 covers a part of the outer circumferential surface of the fixing belt 61 to have a predetermined gap, and suppresses heat radiation from the fixing belt 61. The heat radiation suppression member 70 is configured from a reflecting member 71 and a heat insulating member 72. The reflecting member 71 has a reflecting function that reflects heat radiated from the fixing belt 61. The heat insulating member 72 has a heat insulating function that blocks heat conduction between a side of the fixing belt 61 and its opposite side sandwiching the heat insulating member 72.

The reflecting member 71 is configured by a metal plate of aluminum or the like, and the inner surface (surface facing the fixing belt 61) of the reflecting member 71 is subjected to mirror finishing for improving reflectivity. The reflecting member 71 is arranged to cover the fixing belt 61, from the upper end of the heating roller 62 to the vicinity of the height of the axis position of the upper pressing roller 63, with a predetermined interval from the fixing belt 61. Here, a length of the reflecting member 71 in the width direction (direction orthogonal to sheet feeding direction) of the fixing belt 61 is set slightly narrower than the maximum sheet width to improve workability at the time of jam processing; however it is not limited to this example.

The heat insulating member 72 is configured by a felt sheet of a heat resistant temperature of about 400° C. The heat insulating member 72 is stuck with a heat-resistant tape to the entire surface of the outer surface of the reflecting member 71.

The heat radiation suppression member 70 is divided into a main body part 73 and a movable part 74 at the height of approximate center of the heating roller 62 in a surface of a downstream side of the nip part. The position of the main body part 73 is fixed inside the fixing unit 60. The movable part 74 is rotatably provided around a hinge part 75 provided at a portion in contact with the main body part 73. As illustrated in FIG. 3B, the movable part 74 has a structure that opens about 40° in a direction away from the fixing belt 61 around the hinge part 75.

Incidentally, since the heat insulating member 72 of the heat radiation suppression member 70 can be moved in accordance with movement of the reflecting member 71, a rotatable portion around the hinge part 75 may be only a layer of the reflecting member 71.

The movable part 74 can be moved to a first position illustrated in FIG. 3A and a second position illustrated in FIG. 3B. The first position is a position in which heat radiation from the fixing belt 61 is suppressed, that is, a position in which the end portion of the opposite side to the hinge part 75 of the movable part 74 (lower end of the movable part 74) is closer to the fixing belt 61 than that in the second position. The second position is a position more distant than the first position from a portion (a portion facing the movable part 74 of the fixing belt 61 in FIG. 3A) covered by the movable part 74 in the first position of the fixing belt 61, in the vicinity of a downstream side end portion (hereinafter, referred to as a nip part exit) in a sheet conveying direction of the nip part formed by the fixing belt 61 and a facing member (lower pressing roller 64) that faces the fixing belt 61, and is a position in which a space is wider than that in the first position between the fixing belt 61 in the vicinity of the nip part exit and the movable part 74. Here, the second position is a position in which the movable part 74 is opened about 40° from a state parallel to the fixing belt 61.

Incidentally, the vicinity of the nip part exit is a region close to the nip part exit, and includes a range in which the sheet is jammed in the fixing belt 61 due to separation failure.

The movable part drive unit 2 moves the movable part 74 to the first position or the second position. That is, the movable part drive unit 2 functions as a moving unit.

Figure 4B:
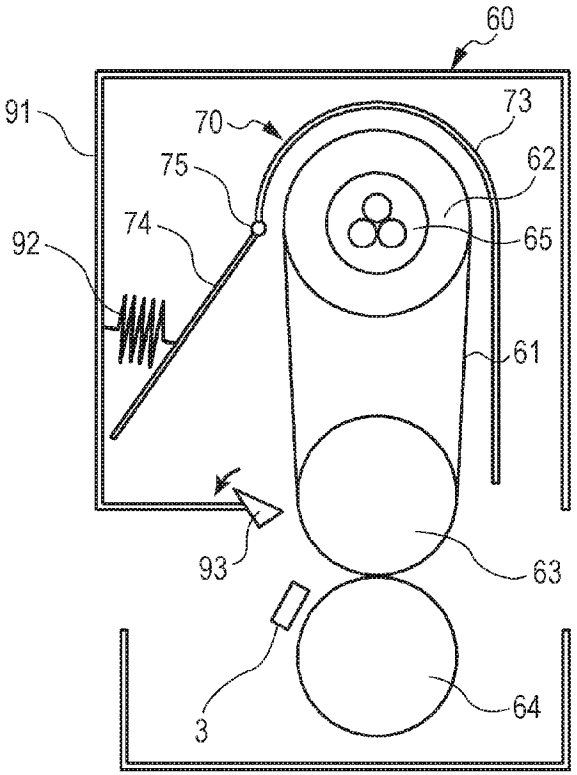
FIGS. 4A and 4B are diagrams for describing a method for moving the movable part in the first embodiment.
Figure 4A:
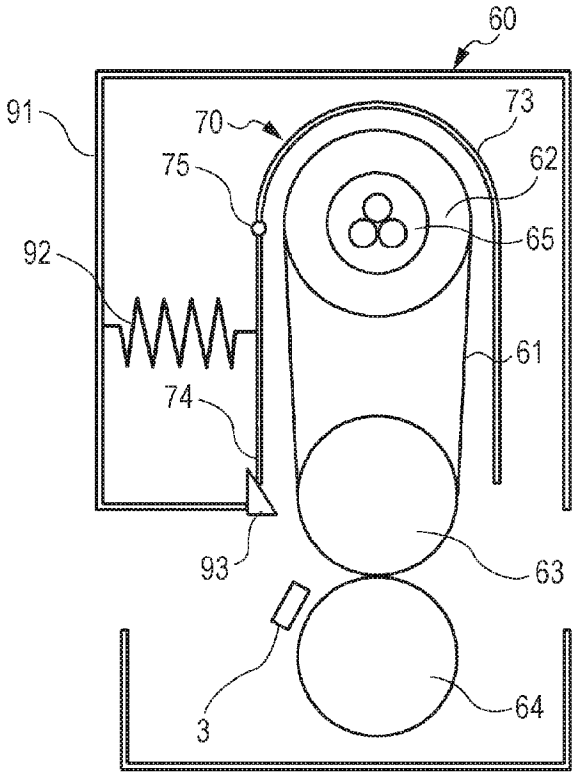

Here, a method for moving the movable part 74 is described with reference to FIGS. 4A and 4B. Incidentally, in FIGS. 4A and 4B, distinction between the reflecting member 71 and the heat insulating member 72 is omitted.

A spring 92 is bridged between the movable part 74 and a side surface of a housing 91 of the fixing unit 60, and the movable part 74 always receives force directed from the first position to the second position. In order to fix the movable part 74 at the first position, a locking part 93 is provided for restraining the lower end of the movable part 74. When fixing of the movable part 74 by the locking part 93 is released, the movable part 74 retreats from the first position (FIG. 4A) to the second position (FIG. 4B) by contraction force of the spring 92.

In the first embodiment, the movable part drive unit 2 moves the movable part 74 from the first position to the second position by changing the position of the locking part 93.

The photo sensor 3 is installed immediately downstream of the nip part in a sheet conveying path inside the fixing unit 60, and detects a jam of the sheet in the vicinity of the nip part exit, and outputs a detection result to the control unit 10. That is, the photo sensor 3 functions as a jam detection unit. For example, when the sheet to be conveyed to an installation position of the photo sensor 3 is not detected at predetermined timing, or when the sheet is detected by the photo sensor 3 installed on a path through which the sheet should not pass, it is determined that the jam occurs.

The jam to be a problem here is a fixing winding jam in which adhesive force is strong between the toner melted on the sheet and the fixing belt 61, and the sheet is conveyed without being separated from the fixing belt 61.

The control unit 10 controls the movable part drive unit 2 to move the movable part 74 from the first position to the second position when the jam of the sheet in the vicinity of the nip part exit is detected by the photo sensor 3. The fixing apparatus according to the present invention is configured by the control unit 10 and the fixing unit 60.

Specifically, the fixing of the movable part 74 by the locking part 93 is released in conjunction with detection of the jam by the photo sensor 3, and the movable part 74 is moved to the second position. Before the sheet of which the jam is detected by the photo sensor 3 reaches between the fixing belt 61 and the movable part 74 in the first position, the movable part 74 is moved from the first position to the second position.

The control unit 10 controls the heating member drive unit 1 to stop driving of the fixing belt 61 when the jam is detected by the photo sensor 3.

A distance from the nip part exit formed by the fixing belt 61 and the lower pressing roller 64 to the photo sensor 3 is shorter than a distance along a circumferential direction of the fixing belt 61 from the nip part exit to the movable part 74 in the first position.

The opening/closing sensor 5 detects opening/closing operation of the fixing unit 60, and outputs a detection result to the control unit 10. For example, when the jam occurs in the fixing unit 60 and the sheet is removed, the user opens the fixing unit 60 to be able to perform work to the fixing unit 60, and closes the fixing unit 60 after ending the jam processing.

When the user opens the fixing unit 60 and removes the sheet jammed and then closes the fixing unit 60, the movable part 74 is returned from the second position to the first position, and the locking part 93 is set so that the movable part 74 is held in the first position. Alternatively, it may be configured so that the lower end of the movable part 74 is grasped by the locking part 93 in accordance with operation of opening the fixing unit 60, and the movable part 74 is returned to the first position and fixed by the locking part 93 in accordance with operation of closing the fixing unit 60.

As described above, with the first embodiment, when the jam is detected, the movable part 74 is moved to the second position, and the space between the movable part 74 and the fixing belt 61 in the vicinity of the nip part exit is made to be wider than that in the first position, so that it is possible to reduce damage of the member such as the fixing belt 61 or the heat radiation suppression member 70 in the fixing unit 60 having the heat radiation suppression member 70. In particular, in the reflecting member 71, it is possible to reduce degradation of reflectivity due to contamination such as toner or paper dust. When the user removes the sheet jammed, the movable part waits at the second position, so that a work space is widened and workability can be improved at the time of the jam processing.

Since the distance from the nip part exit to the photo sensor 3 is shorter than the distance along the circumferential direction of the fixing belt 61 from the nip part exit to the movable part 74 in the first position, the movable part 74 can be moved from the first position to the second position before the sheet of which the jam is detected by the photo sensor 3 reaches between the fixing belt 61 and the movable part 74 in the first position. Thus, it is possible to avoid that the sheet is jammed between the heat radiation suppression member 70 and the fixing belt 61 in a state in which the movable part 74 is in the first position.

Since the driving of the fixing belt 61 is immediately stopped when the jam is detected, the sheet does not enter the vicinity of the upper end of the movable part 74 (a region in which the interval is narrow between the heat radiation suppression member 70 and the fixing belt 61) although there is some time lag until conveying of the sheet stops.

Incidentally, in the first embodiment, the case has been described in which only a part of the heat radiation suppression member 70 (the movable part 74) is moved when the jam occurs; however, it may have a configuration in which the entire of the heat radiation suppression member 70 retreats in a direction in which a space is widened in the vicinity of the nip part exit (configuration in which the entire of the heat radiation suppression member 70 is the movable part 74).

Second Embodiment

Next, a second embodiment is described to which the present invention is applied.

Since an image forming apparatus in the second embodiment has a similar configuration to the image forming apparatus 100 described in the first embodiment, FIG. 1 and FIG. 2 are referenced, and illustrations and descriptions are omitted for the similar configuration to the image forming apparatus 100. Hereinafter, a configuration and operation are described that are characteristic of the second embodiment.

Since the image forming apparatus in the second embodiment includes a fixing unit 160 instead of the fixing unit 60, the fixing unit 60 on the drawing is read as the fixing unit 160.

The fixing unit 160 includes a heating member drive unit 1, a movable part drive unit 2, a photo sensor 3, a temperature sensor 4, and an opening/closing sensor 5 (see FIG. 2).

Figure 5B:
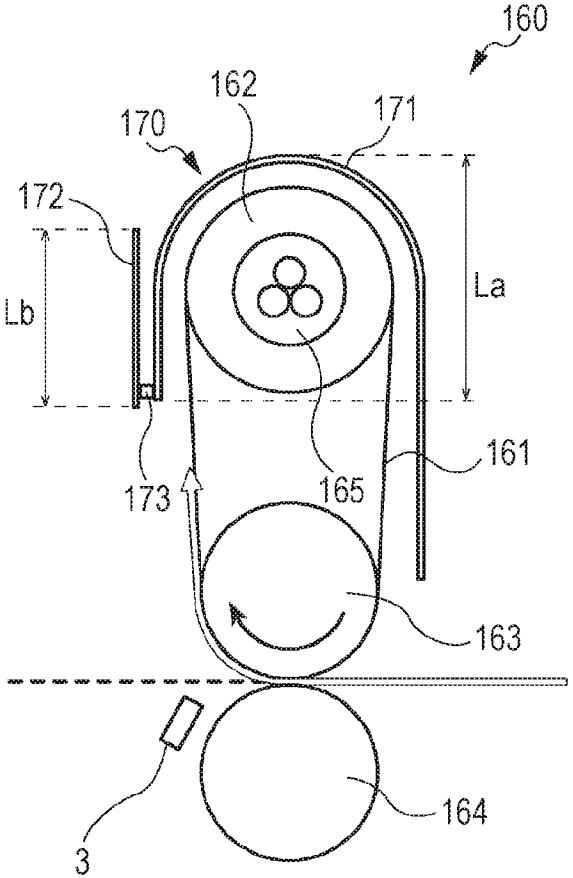
FIG. 5B is a schematic diagram illustrating a cross-sectional configuration of the fixing unit when the movable part is in a second position.
Figure 5A:
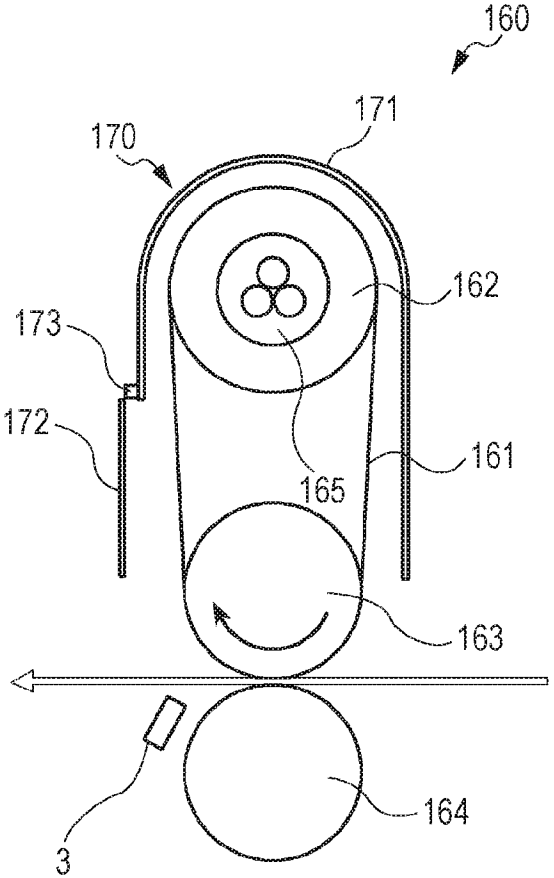
FIG. 5A is a schematic diagram illustrating a cross-sectional configuration of a fixing unit when a movable part is in a first position of an image forming apparatus in a second embodiment.

Each of FIGS. 5A and 5B schematically illustrates a cross-sectional configuration of the fixing unit 160.

The fixing unit 160 includes a fixing belt 161 as a heating member, a heating roller 162, an upper pressing roller 163, a lower pressing roller 164, and a reflecting member 170. In the heating roller 162, the heaters 165 are respectively incorporated at a plurality of positions in an axial direction of the heating roller 162.

Since the fixing belt 161, heating roller 162, upper pressing roller 163, lower pressing roller 164, and heater 165 are respectively similar to the fixing belt 61, heating roller 62, upper pressing roller 63, lower pressing roller 64, and heater 65 included in the image forming apparatus 100 of the first embodiment, descriptions thereof are omitted.

Although it is not illustrated, a heat insulating member is stuck to the outer surface of the reflecting member 170, similarly to the first embodiment.

The reflecting member 170 covers a part of the outer circumferential surface of the fixing belt 161 to have a predetermined gap, and suppresses heat radiation from the fixing belt 161. The reflecting member 170 reflects heat radiated from the fixing belt 161. The reflecting member 170 is configured by a metal plate of aluminum or the like, and the inner surface of the reflecting member 170 is subjected to mirror finishing for improving reflectivity.

The reflecting member 170 has a main body part 171 and a movable part 172. The position of the main body part 171 is fixed inside the fixing unit 160. The movable part 172 can be moved to a first position illustrated in FIG. 5A and a second position illustrated in FIG. 5B. The first position is a position in which heat radiation from the fixing belt 161 is suppressed, and is a position in which the movable part 172 is contiguous with the main body part 171. The second position is a position more distant than the first position from a portion covered by the movable part 172 in the first position of the fixing belt 161, in the vicinity of the nip part exit formed by the fixing belt 161 and the lower pressing roller 164, and is a downstream side position from the first position in a circumferential direction of the fixing belt 161. Here, the second position is a position in which the lower end of the movable part 172 retreats to the outside of the main body part 171 until having substantially the same height as a nip part exit side end portion of the main body part 171. The movable part 172 is moved from the first position to the second position, whereby the portion covered by the movable part 172 in the first position of the fixing belt 161 is opened.

In a surface of the downstream side of the nip part of the reflecting member 170, the boundary between the main body part 171 and the movable part 172 (the lower end of the main body part 171) is at the downstream side from the uppermost position to which the sheet winding around the fixing belt 161 is conveyed (a position to which the sheet is moved even when driving of the fixing belt 161 is stopped due to detection of a jam) in the circumferential direction of the fixing belt 161. A length Lb along the circumferential direction of the fixing belt 161 of the movable part 172 is shorter than a distance La between the nip part exit side end portion of the main body part 171 and the highest point.

The movable part drive unit 2 moves the movable part 172 to the first position or the second position. That is, the movable part drive unit 2 functions as a moving unit.

The control unit 10 controls the movable part drive unit 2 to move the movable part 172 from the first position to the second position when a jam of the sheet in the vicinity of the nip part exit is detected by the photo sensor 3. The fixing apparatus according to the present invention is configured by the control unit 10 and the fixing unit 160.

Specifically, when the jam is detected, the movable part 172 retreats along the fixing belt 161 from the first position in which the movable part 172 faces the fixing belt 161 in the vicinity of the nip part exit (see FIG. 5A) to the second position in which the lower end of the movable part 172 has substantially the same height as the nip part exit side end portion of the main body part 171 (see FIG. 5B).

Figure 6B:
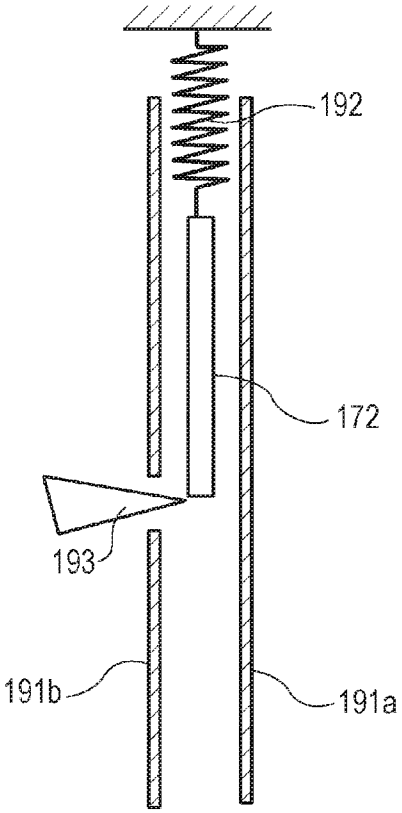
FIGS. 6A and 6B are diagrams for describing a method for moving the movable part in the second embodiment.
Figure 6A:
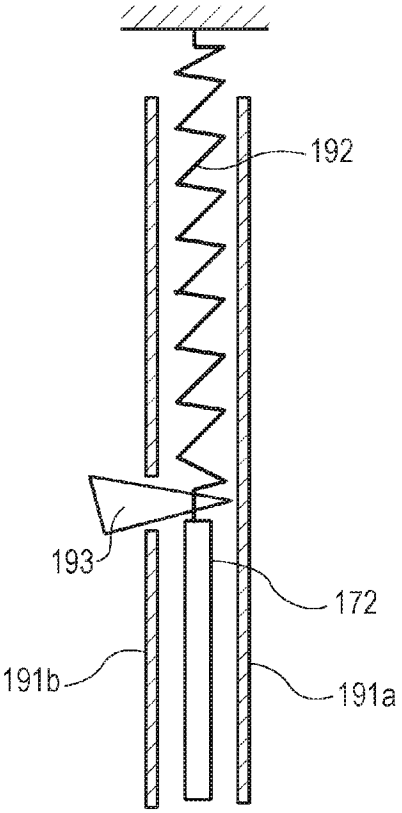

Here, a method for moving the movable part 172 is described with reference to FIGS. 6A and 6B. Movement of the movable part 172 is restricted by rails 191*a*, 191*b* at both end portions in a width direction of the fixing belt 161, and can be moved between the rails 191*a*, 191*b*. A spring 192 is connected with the upper end of the movable part 172, and the movable part 172 always receives force directed from the first position to the second position. In order to fix the movable part 172 at the first position, a locking part 193 is provided for restraining the upper end of the movable part 172. When fixing of the movable part 172 by the locking part 193 is released, the movable part 172 retreats from the first position (FIG. 6A) to the second position (FIG. 6B) by contraction force of the spring 192.

In the second embodiment, the movable part drive unit 2 moves the movable part 172 from the first position to the second position by changing the position of the locking part 193. A moving speed along the circumferential direction of the fixing belt 161 of the movable part 172 is faster than a circumferential speed of the fixing belt 161 (a linear speed along the circumferential direction of the fixing belt 161).

As illustrated in FIG. 5A, a cleaning member 173 made of a sponge is arranged outside the nip part exit side end portion of the main body part 171. The cleaning member 173 cleans a surface (inner surface) facing the fixing belt 161 of the movable part 172, in accordance with movement between the first position and the second position of the movable part 172.

In such a configuration in which the inner surface of the movable part 172 is moved along another member (the main body part 171), a surface facing the movable part 172 of the other member is preferably configured by a material of low friction and low hardness. For example, it is possible to suppress deterioration of a reflecting surface at the time of movement of the movable part 172 by using a felt-like heat insulating member, a Teflon (registered trademark) tape, or the like.

Also in the second embodiment, a distance from the nip part exit formed by the fixing belt 161 and the lower pressing roller 164 to the photo sensor 3 is shorter than a distance along the circumferential direction of the fixing belt 161 from the nip part exit to the movable part 172 in the first position.

When the user opens the fixing unit 160 and removes the sheet jammed and then closes the fixing unit 160, the movable part 172 is returned from the second position to the first position, and the locking part 193 is set so that the movable part 172 is held in the first position. Alternatively, it may be configured so that the movable part 172 is returned to the first position and fixed by the locking part 193 in accordance with operation of closing the fixing unit 160.

As described above, with the second embodiment, when the jam is detected, the movable part 172 is moved to the second position, and the portion covered by the movable part 172 in the first position of the fixing belt 161 is opened, in the vicinity of the nip part exit, so that it is possible to reduce damage of the member such as the fixing belt 161 or the reflecting member 170 in the fixing unit 160 having the reflecting member 170. When the user removes the sheet jammed, a work space is widened and workability can be improved at the time of jam processing.

In the first embodiment, since the movable part 74 retreats in a direction orthogonal to a surface of the fixing belt 61, it is necessary to reserve in advance a space for the movable part 74 to retreat; however, in the second embodiment, the movable part 172 is moved to the downstream side in the circumferential direction of the fixing belt 161, whereby the space is not necessary for retreat, and space saving of the fixing unit 160 can be achieved.

Since the moving speed along the circumferential direction of the fixing belt 161 of the movable part 172 of when the jam occurs is faster than the circumferential speed of the fixing belt 161 (a speed at which the sheet is conveyed in close contact with the fixing belt 161), it is possible to cause the movable part 172 to retreat while the sheet does not reach the lower end of the movable part 172. Even when retreat of the movable part 172 is delayed from a moment when the sheet enters between the reflecting member 170 and the fixing belt 161 by any chance, force is exerted to the sheet in a direction in which the sheet is hardly deformed (travel direction of the sheet), so that deformation of the sheet is suppressed, and damage of the member can be minimized.

The cleaning member 173 is arranged at a position through which the inner surface of the movable part 172 passes when the movable part 172 is moved from the first position to the second position, whereby contamination of the reflecting surface of the movable part 172 is removed, and high reflectivity can be maintained.

When it is assumed that the sheet enters between the reflecting member 170 and the fixing belt 161 in a state in which the movable part 172 is in the first position, there is a possibility that toner or paper dust adhering on the sheet adheres to the inner surface of the movable part 172; however, it is possible to keep a reflecting function of the movable part 172 by cleaning the inner surface of the movable part 172 with the cleaning member 173.

Incidentally, in the second embodiment, the cleaning member 173 is arranged outside the main body part 171, and a moving path of the movable part 172 is arranged outside the main body part 171 for the purpose of cleaning the inner surface of the movable part 172; however, the moving path of the movable part 172 may be inside the main body part 171. However, in a configuration as in the second embodiment, when the sheet reaches a connecting position (boundary between the main body part 171 and the movable part 172) of the reflecting member 170, a possibility is decreased that the sheet is jammed in the connecting position and deformed, and damage of the member can be avoided.

Third Embodiment

Next, a third embodiment is described to which the present invention is applied.

Since an image forming apparatus in the third embodiment has a similar configuration to the image forming apparatus 100 described in the first embodiment, FIG. 1 and FIG. 2 are referenced, and illustrations and descriptions are omitted for the similar configuration to the image forming apparatus 100. Hereinafter, a configuration and operation are described that are characteristic of the third embodiment.

Since the image forming apparatus in the third embodiment includes a fixing unit 260 instead of the fixing unit 60, the fixing unit 60 on the drawing is read as the fixing unit 260.

The fixing unit 260 includes a heating member drive unit 1, a movable part drive unit 2, a photo sensor 3, a temperature sensor 4, and an opening/closing sensor 5 (see FIG. 2).

Figure 7B:
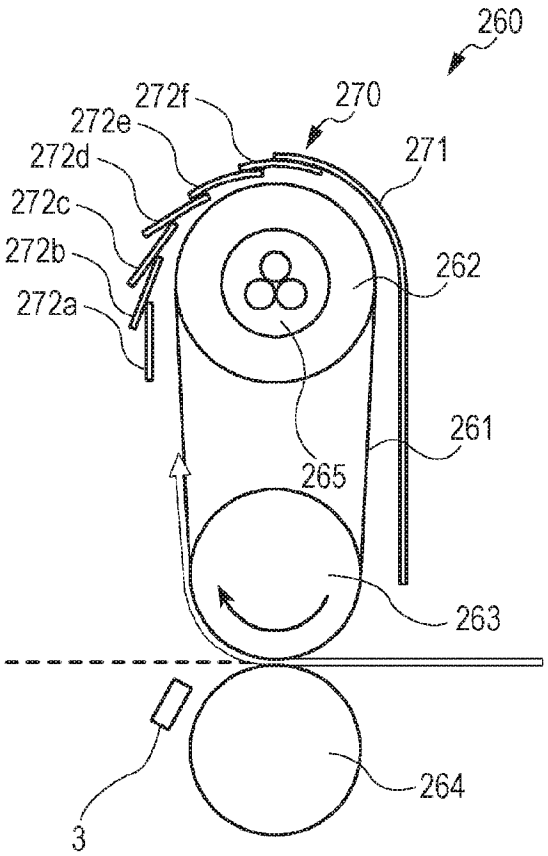
FIG. 7B is a schematic diagram illustrating a cross-sectional configuration of the fixing unit when the movable part is in a second position.
Figure 7A:
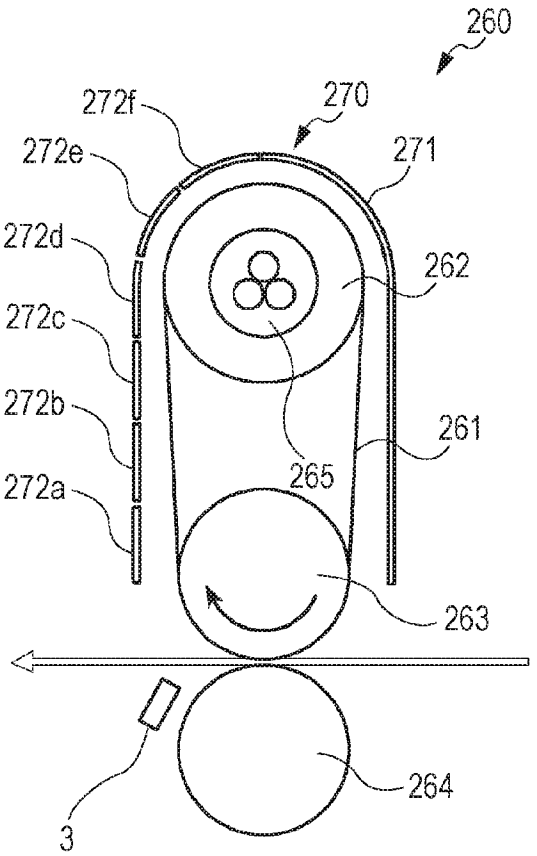
FIG. 7A is a schematic diagram illustrating a cross-sectional configuration of a fixing unit when a movable part is in a first position of an image forming apparatus in a third embodiment.

Each of FIGS. 7A and 7B schematically illustrates a cross-sectional configuration of the fixing unit 260.

The fixing unit 260 includes a fixing belt 261 as a heating member, a heating roller 262, an upper pressing roller 263, a lower pressing roller 264, and a reflecting member 270. In the heating roller 262, the heaters 265 are respectively incorporated at a plurality of positions in an axial direction of the heating roller 262.

Since the fixing belt 261, heating roller 262, upper pressing roller 263, lower pressing roller 264, and heater 265 are respectively similar to the fixing belt 61, heating roller 62, upper pressing roller 63, lower pressing roller 64, and heater 65 included in the image forming apparatus 100 of the first embodiment, descriptions thereof are omitted.

Although it is not illustrated, a heat insulating member is stuck to the outer surface of the reflecting member 270, similarly to the first embodiment.

The reflecting member 270 covers a part of the outer circumferential surface of the fixing belt 261 to have a predetermined gap, and suppresses heat radiation from the fixing belt 261. The reflecting member 270 reflects heat radiated from the fixing belt 261. The reflecting member 270 is configured by a metal plate of aluminum or the like, and the inner surface of the reflecting member 270 is subjected to mirror finishing for improving reflectivity.

The reflecting member 270 has a main body part 271 and movable parts 272*a*, 272*b*, 272*c*, 272*d*, 272*e*, 272*f*. The position of the main body part 271 is fixed inside the fixing unit 260. The movable parts 272*a* to 272*f* can be moved to a first position illustrated in FIG. 7A and a second position illustrated in FIG. 7B. The first position is a position in which heat radiation from the fixing belt 261 is suppressed, and is a position in which the movable parts 272*a* to 272*f* are contiguous all together with the main body part 171. The second position is a position more distant than the first position from a portion covered by the movable parts 272*a* to 272*f* in the first position of the fixing belt 261, in the vicinity of the nip part exit formed by the fixing belt 261 and the lower pressing roller 264, and is a downstream side position from the first position in a circumferential direction of the fixing belt 261. Here, the second position is a position in which the movable parts 272*a* to 272*f* retreat to be sequentially overlapped with each other and brought to a main body part 271 side. The movable parts 272*a* to 272*f* are moved from the first position to the second position, whereby a part of the portion covered by the movable parts 272*a* to 272*f* in the first position of the fixing belt 261 is opened.

The movable part drive unit 2 moves the movable parts 272*a* to 272*f* to the first position or the second position. That is, the movable part drive unit 2 functions as a moving unit.

The control unit 10 controls the movable part drive unit 2 to move the movable parts 272*a* to 272*f* from the first position to the second position when a jam of the sheet in the vicinity of the nip part exit is detected by the photo sensor 3. The fixing apparatus according to the present invention is configured by the control unit 10 and the fixing unit 260.

The control unit 10 determines that the jam is resolved when the jam is detected in the vicinity of the nip part exit of the fixing unit 260 and then opening/closing operation to the fixing unit 260 is detected by the opening/closing sensor 5. That is, a jam resolution detection unit is configured by the control unit 10 and the opening/closing sensor 5.

When resolution of the jam is detected, that is, when the jam is detected in the vicinity of the nip part exit of the fixing unit 260 and the opening/closing operation to the fixing unit 260 is detected by the opening/closing sensor 5, the control unit 10 controls the movable part drive unit 2 so that the movable parts 272*a* to 272*f* are moved from the second position to the first position.

Figure 8B:
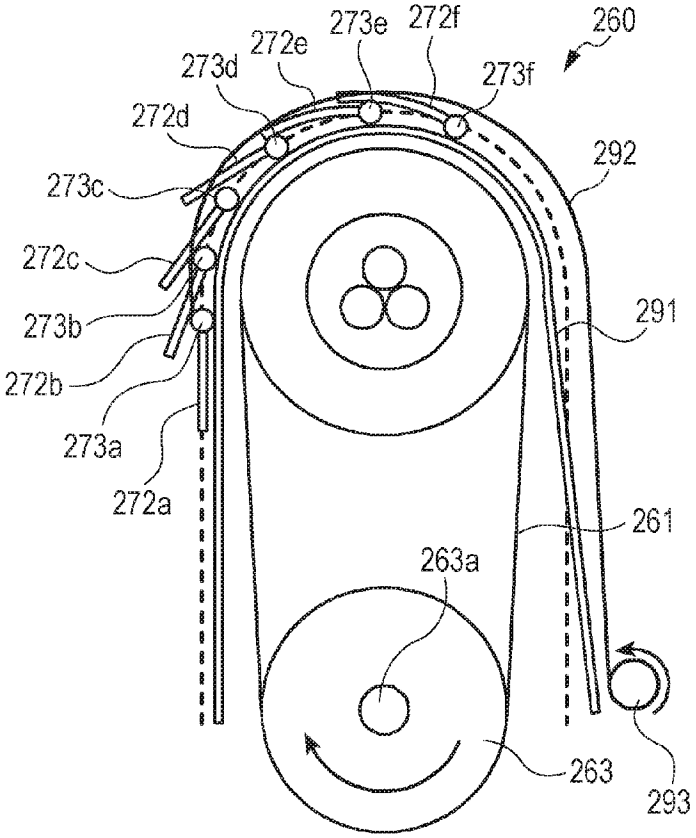
FIGS. 8A and 8B are diagrams for describing a method for moving the movable part in the third embodiment.
Figure 8A:
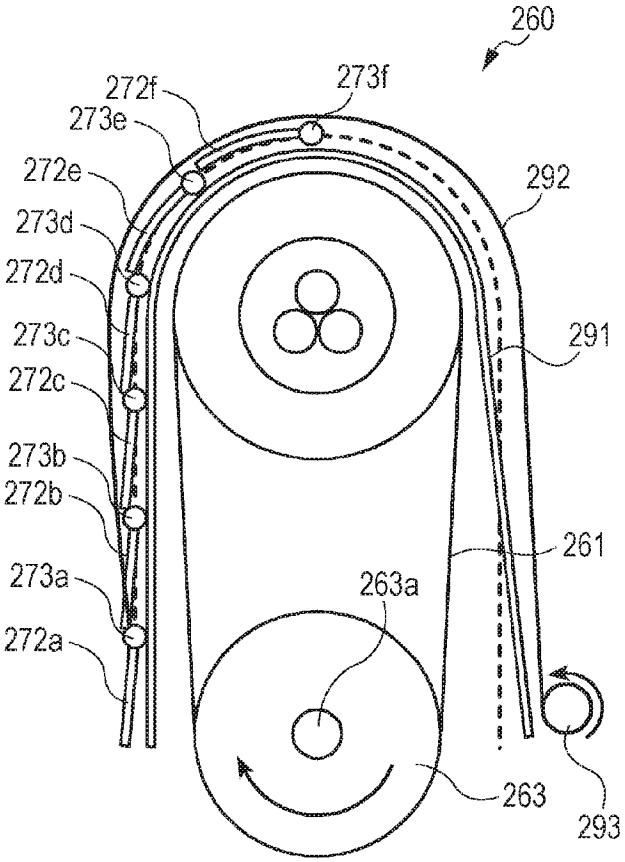

Here, a method for moving the movable parts 272*a* to 272*f* is described with reference to FIGS. 8A and 8B. Incidentally, in each of FIGS. 8A and 8B, the main body part 271 is omitted. A rail 291 is provided along the reflecting member 270 of when the movable parts 272*a* to 272*f* are in the first position, at both end portions in a width direction of the fixing belt 261. The movable parts 272*a* to 272*f* respectively have rotating shafts 273*a* to 273*f* along the width direction of the fixing belt 261. Movement of each of the rotating shafts 273*a* to 273*f* is restricted by the rail 291 in both end portions in the width direction of the fixing belt 261, and can be moved in the circumferential direction of the fixing belt 261 along the rail 291.

A string 292 is fixed to the rotating shaft 273*a* of the movable part 272*a*, and the string 292 is wound by rotation of a winding shaft 293, whereby the movable part 272*a* is elevated along the rail 291.

When the movable part 272*a* is moved by a certain distance, the rotating shaft 273*a* of the movable part 272*a* elevates the rotating shaft 273*b* of the movable part 272*b*, and the movable part 272*b* is also moved with the movable part 272*a*. After that, in accordance with movement of the rotating shaft 273*a* of the movable part 272*a*, the movable parts 272*c* to 272*f* are moved along the rail 291, similarly. The movable parts 272*a* to 272*f* are moved from the first position (FIG. 8A) to the second position (FIG. 8B).

When the jam is detected by the photo sensor 3, the winding shaft 293 for moving the movable parts 272*a* to 272*f* of the reflecting member 270 is connected with a drive shaft 263*a* of the upper pressing roller 263, and the movable parts 272*a* to 272*f* start retreat from the vicinity of the nip part exit at substantially the same speed as a circumferential speed of the fixing belt 261 toward the circumferential direction downstream side of the fixing belt 261 along the rail 291. Specifically, the winding shaft 293 is synchronized in rotation by engagement of gears with the drive shaft 263*a* of the upper pressing roller 263, and a moving speed of the rotating shaft 273*a* of the movable part 272*a* substantially coincides with the circumferential speed of the fixing belt 261. Incidentally, except jam occurrence time, the winding shaft 293 and the drive shaft 263*a* are not connected with each other.

In the third embodiment, the movable part drive unit 2 moves the movable parts 272*a* to 272*f* from the first position to the second position by connecting the winding shaft 293 with the drive shaft 263*a* of the upper pressing roller 263. A moving speed along the circumferential direction of the fixing belt 261 of the movable parts 272*a* to 272*f* is substantially the same as the circumferential speed of the fixing belt 261. Here, substantially the same means that the moving speed of the movable parts 272*a* to 272*f* and the circumferential speed of the fixing belt 261 do not have to be exactly the same as each other.

On the other hand, when the movable parts 272*a* to 272*f* are moved from the second position to the first position, the movable part drive unit 2 releases the connection between the winding shaft 293 and the drive shaft 263*a* of the upper pressing roller 263. Thus, the movable parts 272*a* to 272*f* stopped in the second position are released, and the movable parts 272*a* to 272*f* are moved to the first position due to self-weight of the movable parts 272*a* to 272*f*.

Next, operation in the image forming apparatus of the third embodiment is described.

Figure 9:
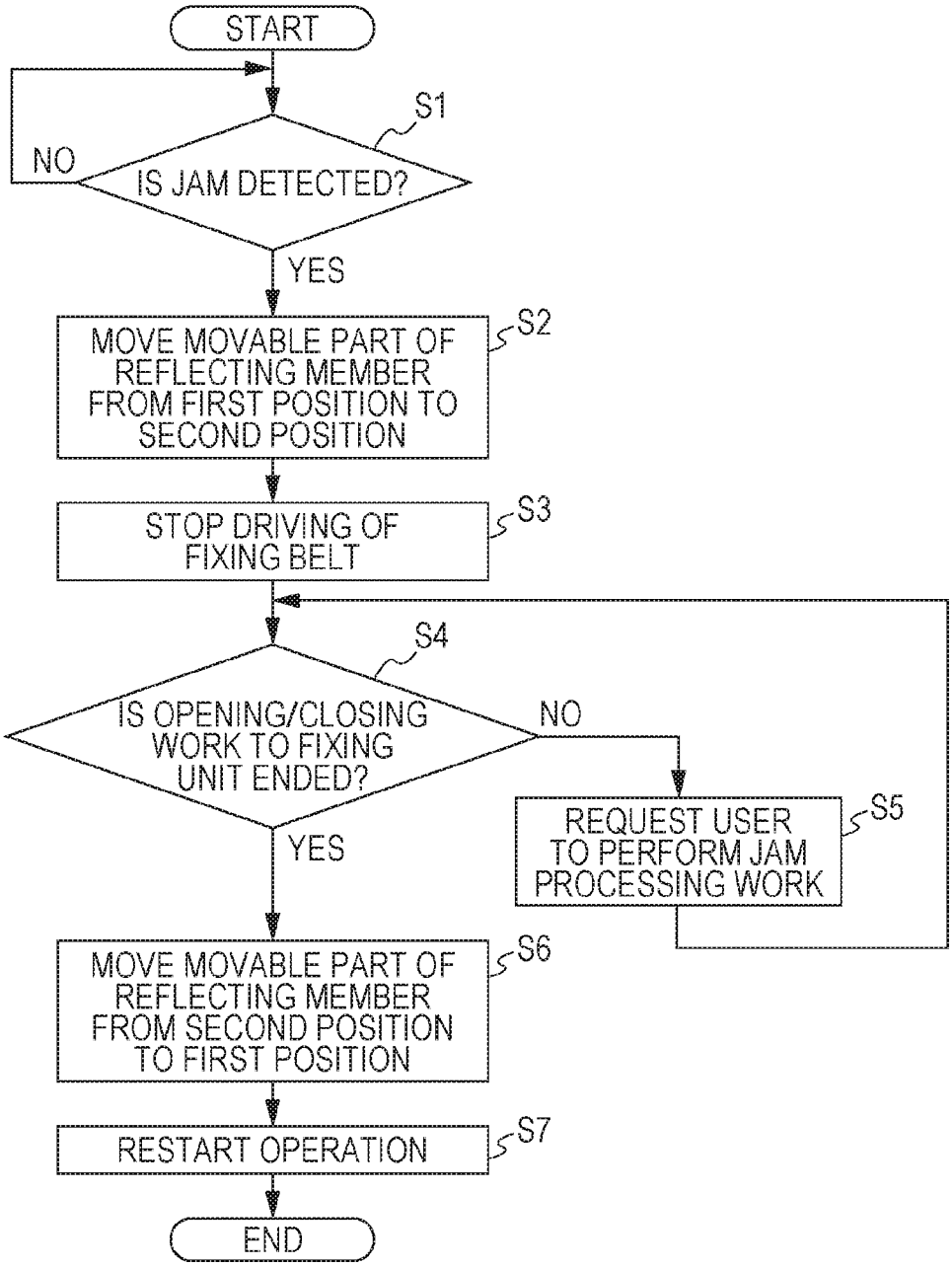
FIG. 9 is a flowchart illustrating a first jam occurrence time processing.

FIG. 9 is a flowchart illustrating first jam occurrence time processing.

First, the control unit 10 determines whether or not the jam is detected in the vicinity of the nip part exit of the fixing unit 260, by the photo sensor 3 (step S1).

When the jam is detected (step S1; YES), the control unit 10 controls the movable part drive unit 2 to connect the winding shaft 293 with the drive shaft 263*a* of the upper pressing roller 263 and to move the movable parts 272*a* to 272*f* of the reflecting member 270 from the first position to the second position (step S2), and controls the heating member drive unit 1 to stop driving of the fixing belt 261 (step S3). The control unit 10 stops the heater 265 in order to ensure safety at the time of sheet removal work by a user.

Next, the control unit 10 determines whether or not opening/closing work to the fixing unit 260 is ended (step S4). Specifically, the control unit 10 determines that the jam is resolved when it is detected by the opening/closing sensor 5 that the fixing unit 260 is opened and then closed.

When the opening/closing work to the fixing unit 260 is not ended (step S4; NO), the control unit 10 displays a message for prompting jam processing work on the display unit 21, and requests the user to perform the jam processing work (step S5). After that, the processing returns to step S4.

In step S4, when the opening/closing work to the fixing unit 260 is ended (step S4; YES), that is, when the resolution of the jam is detected in the fixing unit 260, the control unit 10 controls the movable part drive unit 2 to release the connection between the winding shaft 293 and the drive shaft 263*a* of the upper pressing roller 263 and to move the movable parts 272*a* to 272*f* of the reflecting member 270 from the second position to the first position (step S6).

Next, the control unit 10 restarts operation of the image forming apparatus (step S7).

Thus, the first jam occurrence time processing is ended.

As described above, with the third embodiment, when the jam is detected, the movable parts 272*a* to 272*f* are moved to the second position, and a part of the portion covered by the movable parts 272*a* to 272*f* in the first position of the fixing belt 261 is opened, in the vicinity of the nip part exit, so that it is possible to reduce damage of the member such as the fixing belt 261 or the reflecting member 270 in the fixing unit 260 having the reflecting member 270. When the user removes the sheet jammed, a work space is widened and workability can be improved at the time of jam processing.

The movable parts 272*a* to 272*f* are caused to retreat to the downstream side in the circumferential direction of the fixing belt 261, whereby the space is not necessary for retreat, and space saving of the fixing unit 260 is achieved.

When the jam is detected, the fixing belt 261 is stopped at substantially the same time; however, rotation of the fixing belt 261 is continued by inertia, so that it is possible to cause the movable parts 272*a* to 272*f* to retreat to substantially the same position as the sheet at substantially the same speed as the sheet by moving the movable parts 272*a* to 272*f* at substantially the same speed as the fixing belt 261.

Even when the sheet enters between the reflecting member 270 and the fixing belt 261 before movement of the movable parts 272*a* to 272*f* is started, it is possible to reduce force to be applied to the sheet entering (force to be pulled from both of the reflecting member 270 and the fixing belt 261 due to a speed difference therebetween), and to avoid further deformation of the sheet or damage of the member. In particular, it is effective in a system in which a driving speed of the fixing belt 261 is fast, and a conveying distance of the sheet from when the jam is detected until the movable parts 272*a* to 272*f* retreat is long, or a system in which the jam detection unit such as the photo sensor 3 cannot be installed to be adjacent to the nip part, and entering of the sheet cannot be avoided while the movable parts 272*a* to 272*f* are in the first position.

When the resolution of the jam is detected, the movable parts 272*a* to 272*f* are moved from the second position to the first position, so that it is possible to prevent erroneous operation (degradation of heat radiation suppressing effect or local overheating) due to returning failure of the movable parts 272*a* to 272*f*, and the user does not have to manually return the position of the movable parts 272*a* to 272*f*, and operability is improved.

Incidentally, in the third embodiment, the drive shaft 263*a* of the upper pressing roller 263 is used in order to move the movable parts 272*a* to 272*f* at substantially the same speed as the fixing belt 261; however, the movable parts 272*a* to 272*f* may be moved in accordance with movement of the sheet by using force of the sheet to adhere to the movable parts 272*a* to 272*f* without providing a driving device for the movable parts 272*a* to 272*f*.

In the third embodiment, when the movable parts 272*a* to 272*f* are moved from the second position to the first position, the connection is released between the winding shaft 293 and the drive shaft 263*a* of the upper pressing roller 263; however, the winding shaft 293 may be rotated in the opposite direction to that when the movable parts 272*a* to 272*f* are moved from the first position to the second position, by rotating the drive shaft 263*a* of the upper pressing roller 263 in the opposite direction to that at the time of normal image formation, in a state in which the connection is maintained between the winding shaft 293 and the drive shaft 263*a* of the upper pressing roller 263.

[Modification]

Next, a modification of the third embodiment is described. Here, only a difference from the third embodiment is described.

In the modification, it is different from the third embodiment that the resolution of the jam is detected on the basis of a rate of temperature rise of the fixing belt 261 after recovering from jam processing. When the sheet remains in the periphery of the fixing belt 261, heat capacity is increased, and the rate of temperature rise of the fixing belt 261 is slower than usual. For this reason, it is possible to determine presence of the sheet on the basis of a temperature measured by the temperature sensor 4.

The control unit 10 determines whether or not the rate of temperature rise of the fixing belt 261 is normal, on the basis of the temperature measured by the temperature sensor 4, after the jam occurs in the vicinity of the nip part exit of the fixing unit 260 and heating of the fixing belt 261 is restarted. Specifically, the control unit 10 determines that the jam is resolved when the rate of temperature rise of the fixing belt 261 is a predetermined value or more. On the other hand, the control unit 10 determines that the sheet remains in the periphery of the fixing belt 261, that is, the jam is not resolved when the rate of temperature rise of the fixing belt 261 is less than the predetermined value. That is, the jam resolution detection unit is configured by the control unit 10 and the temperature sensor 4.

When the resolution of the jam is detected, that is, when the jam is detected in the vicinity of the nip part exit of the fixing unit 260, and the rate of temperature rise is normal in re-heating of the fixing belt 261, the control unit 10 controls the movable part drive unit 2 to move the movable parts 272*a* to 272*f* from the second position to the first position.

Figure 10:
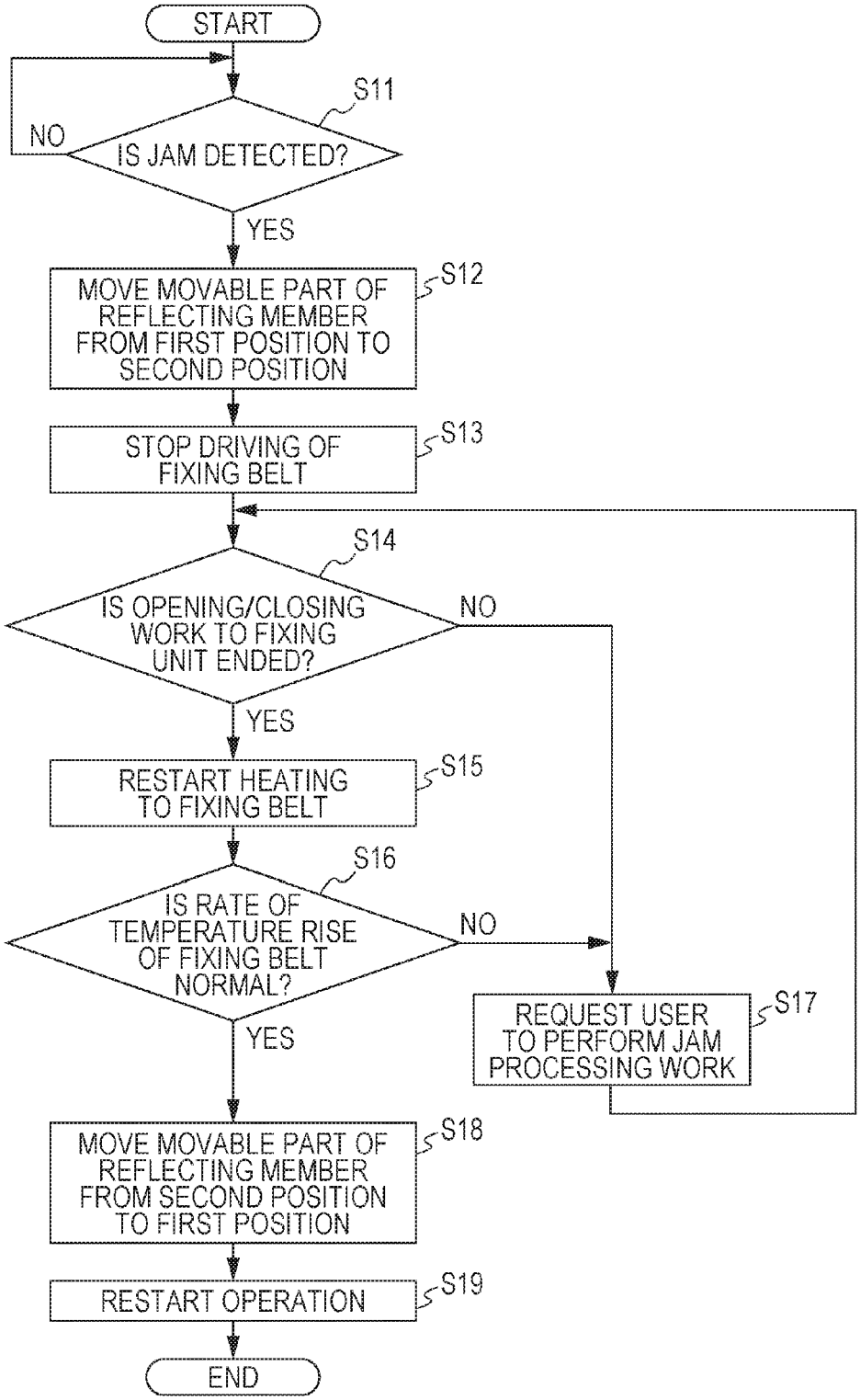
FIG. 10 is a flowchart illustrating second jam occurrence time processing in a modification of the third embodiment.
Figure 11:
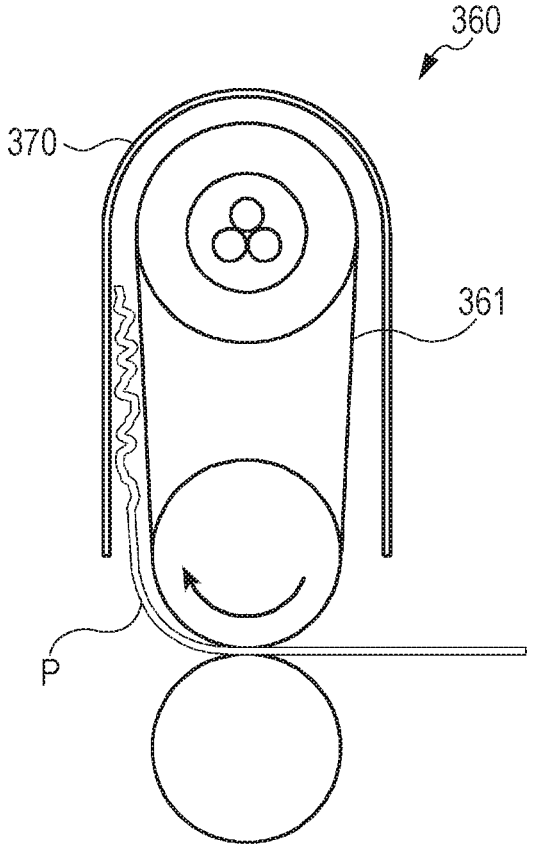
FIG. 11 is a diagram for describing a problem in a conventional fixing apparatus.

FIG. 10 is a flowchart illustrating second jam occurrence time processing.

Since processing of step S11 to step S13 is similar to the processing of step S1 to step S3 of the first jam occurrence time processing illustrated in FIG. 9, the description thereof is omitted.

Next, the control unit 10 determines whether or not opening/closing work to the fixing unit 260 is ended (step S14).

When the opening/closing work to the fixing unit 260 is ended (step S14; YES), the control unit 10 controls the heater 265 to restart heating of the fixing belt 261 (step S15).

Next, the control unit 10 acquires the temperature measured by the temperature sensor 4, and determines whether or not the rate of temperature rise of the fixing belt 261 is normal (step S16). Specifically, the control unit 10 determines that the sheet does not remain in the periphery of the fixing belt 261, that is, the jam is resolved when the rate of temperature rise of the fixing belt 261 is normal.

When the opening/closing work to the fixing unit 260 is not ended in step S14 (step S14; NO), or when the rate of temperature rise of the fixing belt 261 is not normal in step S16 (step S16; NO), the control unit 10 displays a message for prompting jam processing work on the display unit 21, and requests the user to perform the jam processing work (step S17). Here, when the fixing belt 261 is being re-heated, the control unit 10 stops the heater 265. After that, the processing returns to step S14.

In step S16, when the rate of temperature rise of the fixing belt 261 is normal (step S16; YES), that is, when the resolution of the jam is detected in the fixing unit 260, the control unit 10 controls the movable part drive unit 2 to release the connection between the winding shaft 293 and the drive shaft 263*a* of the upper pressing roller 263, and to move the movable parts 272*a* to 272*f* of the reflecting member 270 from the second position to the first position (step S18).

Next, the control unit 10 restarts operation of the image forming apparatus (step S19).

Thus, the second jam occurrence time processing is ended.

With the modification, the resolution of the jam is detected on the basis of the rate of temperature rise in re-heating of the fixing belt 261, and when the resolution of the jam is detected, the movable parts 272*a* to 272*f* are moved from the second position to the first position, so that it is possible to prevent erroneous operation due to returning failure of the movable parts 272*a* to 272*f*, and the user does not have to manually return the position of the movable parts 272*a* to 272*f*, and operability is improved.

Incidentally, descriptions in the above embodiments are examples of the fixing apparatus and the image forming apparatus according to the present invention, and are not limited thereto. The detailed configuration and detailed operation of each unit configuring the apparatus can also be modified if appropriate within a range without departing from the spirit of the present invention.

For example, the configurations and operations that are characteristic of the above embodiments may be combined with each other.

In each of the above embodiments, the case has been described in which the heat radiation suppression member has both of the reflecting function and the heat insulating function; however, the heat radiation suppression member may have either of the reflecting function or the heat insulating function.

In each of the embodiment, the case has been described in which the heat radiation suppression member covers a part of the outer circumferential surface of the heating member (fixing belt); however, the heat radiation suppression member may cover the entire of the outer circumferential surface of the heating member.

The method for moving the movable part is also not limited to the examples illustrated in the above embodiments.

In the first embodiment and the second embodiment, a mechanism may be included that automatically returns the movable part from the second position to the first position.

Although the present invention has been described and illustrated in detail, it is clearly understood that the same is by way of illustrated and example only and is not to be taken by way of limitation, the scope of the present invention being interpreted by terms of the appended claims.

What is claimed is:

1. A fixing apparatus comprising:

a heating member that has an outer circumferential surface to be driven in a circulative manner and heats a sheet on which color material is transferred;

a heat radiation suppression member that covers at least a part of an outer circumferential surface of the heating member to have a predetermined gap and suppresses heat radiation from the heating member, wherein the heat radiation suppression member has a movable part capable of moving to a first position in which the heat radiation from the heating member is suppressed, and a second position more distant than the first position from a part covered by the heating member in the first position, in a vicinity of a downstream side end portion in a sheet conveying direction of a nip part formed by the heating member and a facing member that faces the heating member;

a moving unit that moves the movable part to the first position or the second position;

a jam detection unit that detects a jam of a sheet in the vicinity of the downstream side end portion of the nip part; and a control unit that controls the moving unit such that the movable part is moved from the first position to the second position, when the jam is detected by the jam detection unit.

2. The fixing apparatus according to claim 1, wherein the second position is a position at which a space is wider than in the first position, between the movable part and the heating member in the vicinity of the downstream side end portion of the nip part.

3. The fixing apparatus according to claim 2, wherein the movable part moves from the first position to the second position before a sheet of which a jam is detected by the jam detection unit reaches between the heating member and the movable part in the first position.

4. The fixing apparatus according to claim 1, wherein the second position is a downstream side position from the first position in a circumferential direction of the heating member.

5. The fixing apparatus according to claim 4, wherein a moving speed along the circumferential direction of the heating member of the movable part is faster than a circumferential speed of the heating member.

6. The fixing apparatus according to claim 4, wherein a moving speed along the circumferential direction of the heating member of the movable part is substantially the same as a circumferential speed of the heating member.

7. The fixing apparatus according to claim 1, wherein a distance from the downstream side end portion of the nip part to the jam detection unit is shorter than a distance along a circumferential direction of the heating member from the downstream side end portion of the nip part to the movable part in the first position.

8. The fixing apparatus according to claim 1, further comprising:

a jam resolution detection unit that detects resolution of a jam, wherein the control unit controls the moving unit such that the movable part is moved from the second position to the first position when the resolution of the jam is detected by the jam resolution detection unit.

9. The fixing apparatus according to claim 1, wherein the heat radiation suppression member has at least one of (i) a reflecting function that reflects heat radiated from the heating member, and (ii) a heat insulating function that blocks heat conduction from the heating member past the heat radiation suppression member.

10. The fixing apparatus according to claim 4, wherein the heat radiation suppression member comprises:

a reflecting member that reflects heat radiated from the heating member; and a cleaning member that cleans a surface facing the heating member of the movable part in accordance with movement between the first position and the second position of the movable part.

11. An image forming apparatus comprising the fixing apparatus according to claim 1.

* * * * *